United States Patent [19]

Dolezal et al.

[11] Patent Number: 4,574,895

[45] Date of Patent: Mar. 11, 1986

[54] SOLID HEAD BIT WITH TUNGSTEN CARBIDE CENTRAL CORE

[75] Inventors: George E. Dolezal, Friendswood; Joseph L. Kelly, Jr., Houston, both of Tex.

[73] Assignee: Hughes Tool Company - USA, Houston, Tex.

[21] Appl. No.: 566,962

[22] Filed: Dec. 29, 1983

Related U.S. Application Data

[63] Continuation of Ser. No. 351,058, Feb. 22, 1982, abandoned.

[51] Int. Cl.[4] ..... E21B 10/46; E21B 10/62

[52] U.S. Cl. ..... 175/329; 175/400; 175/409

[58] Field of Search ..... 175/404, 329, 330, 409–412, 175/422, 400, 398, 333–335, 393

[56] References Cited

U.S. PATENT DOCUMENTS

| | | | |
|---|---|---|---|
| 122,514 | 1/1872 | Bullock | 175/329 |
| 613,340 | 11/1898 | Vollth | 175/404 |
| 1,506,119 | 8/1924 | Hansen | 175/330 |
| 2,053,801 | 9/1936 | Mitchell | 175/330 |
| 2,262,001 | 11/1941 | Hokanson | 175/412 |
| 2,543,861 | 3/1951 | Mader | 175/404 |
| 2,545,195 | 3/1951 | Crake | 175/404 |
| 2,633,335 | 3/1953 | Hart | 175/418 |
| 2,884,227 | 4/1959 | Hjalsten | 175/410 |
| 2,976,944 | 3/1961 | Bassinger | 175/410 |
| 4,244,432 | 1/1981 | Rowley et al. | 175/410 |
| 4,301,877 | 11/1981 | Cloud | 175/340 |
| 4,406,336 | 9/1983 | Olsen et al. | 175/410 |

FOREIGN PATENT DOCUMENTS

| | | | |
|---|---|---|---|
| 590939 | 4/1959 | Italy | 175/422 |
| 1323284 | 7/1973 | United Kingdom | 175/400 |
| 791890 | 12/1980 | U.S.S.R. | 175/403 |

*Primary Examiner*—Stephen J. Novosad
*Assistant Examiner*—Hoang C. Dang
*Attorney, Agent, or Firm*—Robert A. Felsman; James E. Bradley

[57] ABSTRACT

A solid head earth boring bit has a central tungsten carbide core sealed at the lower end of a drilling fluid passage that extends through the bit to the face of the bit. The core has a nozzle passage extending through it that is offset from the axis of the drilling fluid passage. The core also has at least one cutting element secured to its face. The cutting elements are secured in holes in the core.

4 Claims, 2 Drawing Figures

SOLID HEAD BIT WITH TUNGSTEN CARBIDE CENTRAL CORE

This application is a continuation of application Ser. No. 351,058, filed 2/22/82, now abandoned.

BACKGROUND OF THE INVENTION

This invention relates in general to earth boring bits, and in particular to a solid head bit with a wear resistant core containing a nozzle passage and at least one cutting element.

Most oil and gas wells are drilled with rolling cutter bits. In some formations, however, solid head bits have been found to be more efficient. These solid head bits are of steel and have a lower face within which a number of cutting elements are secured in holes. Each cutting element has a cylindrical tungsten carbide stud located in the hole, and a flat cutting edge bonded to the stud and facing in the direction of rotation. The cutting edge consists of polycrystalline diamond on a tungsten carbide substrate.

Each drill bit has an axial drilling fluid passage with one or more outlets. To reduce erosion of the steel body of the bit, a tungsten carbide nozzle is located at the outlet. For good bottom hole coverage, it is desirable to place some of the cutting elements close to the nozzles. However, because of the hole required for the stud, and the necessary supporting metal around each stud hole, it is difficult to place the cutting elements in the optimum positions. Erosion of the supporting metal occurs if the cutting element is placed too close to the nozzle, resulting in a loss of the element.

In U.S. Pat. No. 4,303,136, Harry N. Ball, Dec. 1, 1981, a cutting element with a flat cutting edge is shown with a passage formed through the base of the cutting element. The purpose of the passage is to discharge drilling fluid across the cutting edge. However, the passage appears likely to be subject to plugging because of its small diameter.

SUMMARY OF THE INVENTION

In this invention, a solid head bit is provided with a core secured at an outlet of the drilling fluid passage. This core is of hard, wear resistant material and has a nozzle passage extending through it that is in communication with the drilling fluid passage. Also, the core has one or more cutting edges secured to its face. Preferably the nozzle passage in the core is offset from the axis of the drill bit. The cutting edges may be optimally positioned close to the outlet of the nozzle passage for providing good bottom hole coverage.

The cutting edge is preferably secured to a stud or base that is brazed in a hole in the core. The core diameter allows a nozzle passage that is at least one half the diameter of the cutting edge. The core is held by a snap ring retainer and sealed with an O-ring.

DESCRIPTION OF THE PREFERRED EMBODIMENT

Figure 1:
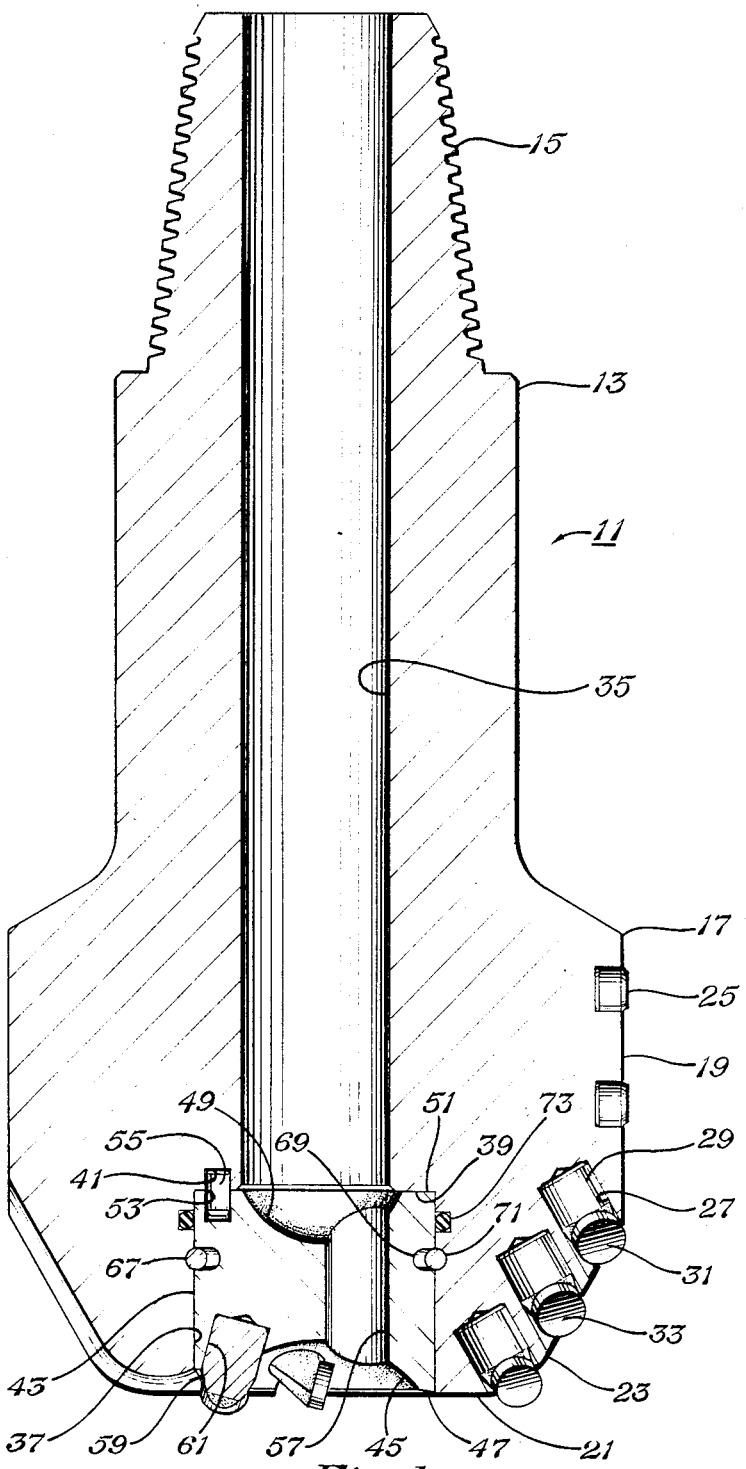
FIG. 1 is a vertical-sectional view of a drill bit constructed in accordance with this invention.

Referring to FIG. 1, drill bit 11 has a body 13 that is forged from a single piece of steel. Threads 15 are formed on the upper end for securing to a string of drill pipe. An enlarged head 17 is located on the lower end of body 13. Head 17 has a plurality of cylindrical segments 19 that are spaced-apart and shown more clearly in FIG. 2. Head 17 has on its lower end a face, which is made-up of a central portion 21 and a frusto-conical portion 23. The central portion 21 is flat and located in a plane perpendicular to the axis of drill bit 11. The frusto-conical portion 23 extends between the central portion 21 and the cylindrical portion 19.

Figure 2:
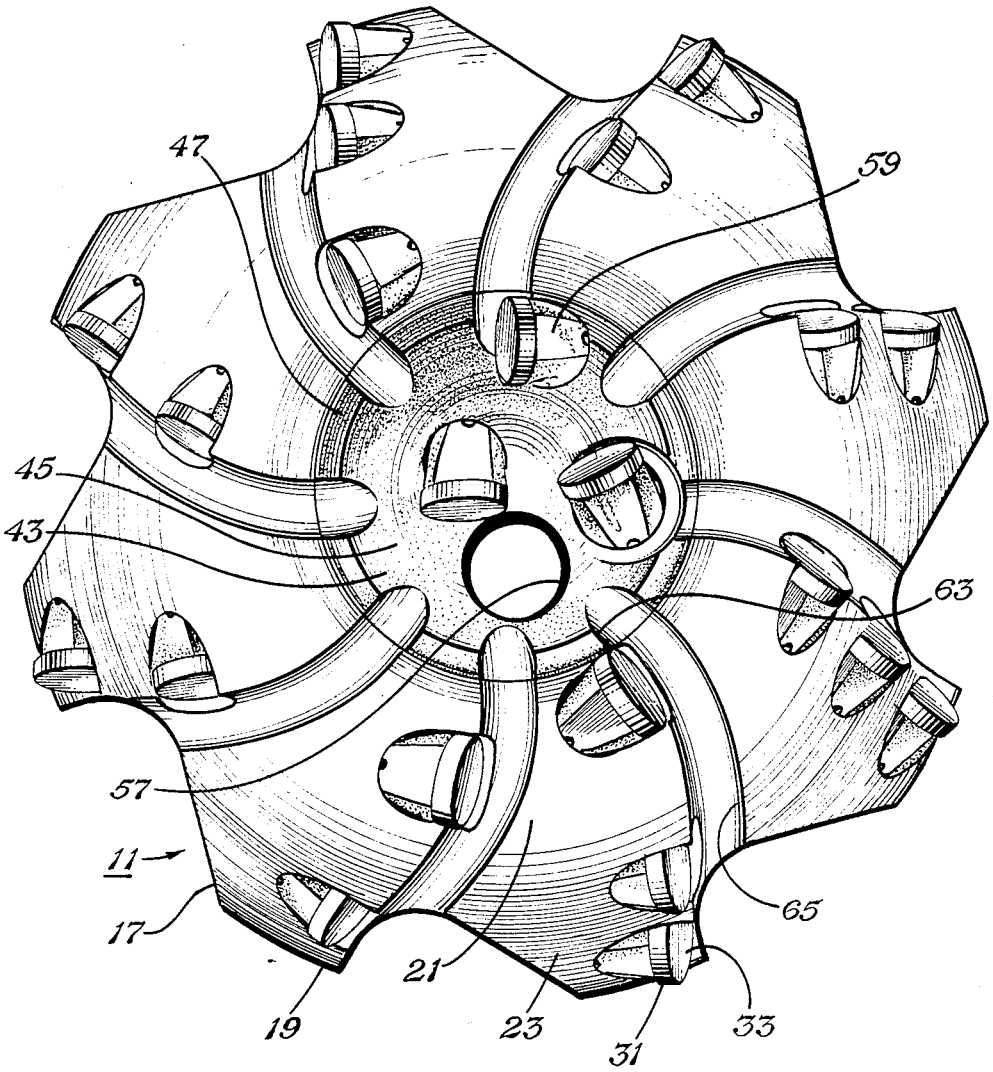
FIG. 2 is a bottom view of the drill bit of FIG. 1.

The cylindrical portion 19 has a plurality of inserts 25 of hard metal such as tungsten carbide interferingly secured in mating holes. Both the central portion 21 and frusto-conical portion 23 of the face have a plurality of holes 27 formed therein. Each hole receives a tungsten carbide base or cylindrical stud 29 of a cutting element 31. Each cutting element 31 has a cutting edge 33 bonded to the stud 29. Cutting edge 33 is circular and faces into the direction of rotation. Cutting edge 33 is a laminated disk containing polycrystalline diamond on the face backed by a tungsten carbide substrate. Cutting edges 33 are conventional and marketed by the General Electric Company. As shown in FIG. 1, holes 27 are generally inclined with respect to the axis of bit 11. As shown in FIG. 2, holes 27 are widely dispersed about the face of drill bit 11.

Body 13 has an axial passage 35. The lower end of axial passage 35 is an enlarged counterbore section 37 centrally located on the axis of bit 11. Counterbore section 37 has a cylindrical wall surface with a larger diameter than the upper portion of passage 35. A downwardly facing annular shoulder 39 forms the base of counterbore section 37. A small, cylindrical cavity or hole 41 is formed at one point on shoulder 39.

A core 43 is adapted to be secured in counterbore section 37. Core 43 is constructed of a hard, wear-resistant material of hardness considerably greater than body 13, such as sintered tungsten carbide. Typically body 13 may have a hardness of about 38 Rockwell C, while tungsten carbide might be 87–90 Rockwell A. Core 43 has a cylindrical wall surface and a lower face with a concave or depressed section 45. Concave section 45 is circular, as shown in FIG. 2, with an axis that coincides with the axis of the bit. Concave section 45 is about one-fourth of a spherical surface and has a width that extends almost completely across the diameter of core 43. The face also includes a perimeter or circular rim 47 that encircles concave section 45. Rim 47 defines a corner with a cylindrical sidewall of core 43.

A concave depression 49 is also located on the upper end of core 43. Concave section 49 is circular and located on the axis of bit 11. Concave section 49 is somewhat more than one-fourth of a spherical surface, and has a width that is equal or slightly greater than the diameter of axial passage 35. The upper end of core 43 has a circular portion 51 that surrounds concave section 49 and intersects the sidewall of core 43. Circular portion 51 is flat, located in a plane perpendicular to the axis of core 43, and adapted to seat against shoulder 39. A cylindrical hole or cavity 53 is formed in the core circular portion 51 for registering with hole 41 formed in the shoulder 39. A cylindrical pin 55 fits tightly within holes 41 and 53 for preventing rotation of core 43 with respect to the bit 11. Pin 55 has a length that is slightly less than the cumultive depths of the holes 41 and 53. The height of core 43 from rim 47 to circular portion 51 is equal to the depth of counterbore section 37, making rim 47 flush with bit central portion 21.

A nozzle passage 57 is located in core 43, and extends between the concave sections 45 and 49. The axis of nozzle passage 57 is parallel to the axis of drilling fluid passage 35, but noncoinciding or offset to one side. The diameter of nozzle passage 57 is greater than one-half the width or diameter of the cutting edge 33. Preferably the diameter of nozzle passage 57 is greater than the diameter of cutting edge 33 and also greater than the diameter of stud 29.

The diameter of core 45 is less than one-half the diameter of the cylindrical sidewall portion 19.

In this embodiment, three cutting elements 59 are located in the lower end or face of core 43. Each cutting element 59 is identical to the cutting elements 31 located in the bit face portions 21 and 23. Each cutting element 59 is located in a cylindrical hole 61 formed in core 43. The holes 61 are drilled for optimum positioning and may be inclined, as shown in FIG. 1. As shown in FIG. 2, one of the cutting elements 59 is located very close to nozzle passage 57. Another cutting element 59 is placed slightly further outward, and the third is located near the edge of core 43. The cutting edges of the cutting elements 59 all face generally into the direction of rotation, but are not necessarily located on radial lines. The diameter of core 43 is at least twice the diameter of the cutting edge 33. The core 43 diameter is also at least twice the diameter of each hole 61.

Also, referring still to FIG. 2, channels 63 are formed in the face of core 43 for registering with channels 65 formed in the bit face portions 19 and 21. Each channel 63 begins in the concave section and extends through the rim 47, where it merges with one of the channels 65. Channels 65 are curved to direct drilling fluid past the faces of the cutting edges 33 and to the recessed portions or flutes between cylindrical segments 19.

Core 43 is retained in counterbore section 37 by retaining means that includes a snap ring 67. Snap ring 67 is circular in transverse cross-section, and fits within grooves 69 and 71 formed in core 43 and counterbore section 37, respectively. Groove 69 is of a depth greater than the thickness of snap ring 67, to enable snap ring 67 to be compressed fully within groove 69. This allows the core 43 to be inserted into counterbore section 37. Groove 71 is of a depth about half the thickness of snap ring 67. A seal means comprising an O-ring 73 is located in a groove in counterbore section 37 to seal against leakage.

Core 43 is manufactured by conventional powder metallurgy techniques. Tungsten carbide granules located within a matrix of cobalt or the like are formed into the desired shape, then sintered in a furnace. Some of the features such as the groove 69, and holes 53 and holes 61 may be machined after molding but before sintering. After sintering, little or no machining work is required. To assemble the bit, the snap ring 67, which is split, is placed around and compressed into groove 69. Pin 55 is positioned either in hole 41 or hole 53. The core 43 is pushed into counterbore section 37. By rotating core 43 slightly, the pin 55 will register the two holes 41 and 53. Further depression results in the snap ring 67 springing radially outward and locking into groove 71. The cutting elements 59 are brazed into holes 61 with a material such as silver. The cutting elements 31 are pressed into holes 27.

In operation, bit 11 will be secured to a string of drill pipe and lowered into the hole. The drill pipe is rotated, rotating the bit 11 with it. The cutting edges of the cutting elements 31 and 59 scrape and disintegrate the formation during rotation. Drilling fluid, normally a liquid, is pumped down the drill string, through drilling fluid passage 35 and nozzle passage 57 to discharge against the borehole bottom. The drilling fluid flows along channels 63, 65 and up between cylindrical segments 19. The fluid flushes cuttings from the borehole and returns the cuttings to the surface. The elevations of cutting elements 59 in concave section 45 are chosen to allow a conical portion to build up in the borehole bottom to assist in centering the bit.

The invention has significant advantages. The core of tungsten carbide allows cutting elements to be positioned optimally around the nozzle outlet. The core reduces erosion around the nearby cutting elements because of its hardness and high resistance to wear.

While the invention has been shown in only one of its forms, it should be apparent to those skilled in the art that it is not so limited but is susceptible to various changes and modifications without departing from the spirit of the invention.

We claim:

1. An earth boring bit, comprising in combination:

a steel body having a face on its lower end that includes a circular central portion and a frusto-conical portion surrounding and extending upwardly from the central portion to a cylindrical sidewall portion at the periphery of the bit;

a drilling fluid passage extending axially through the bit and terminating in an outlet at the face;

a plurality of cutting elements secured within holes formed in the central portion and frusto-conical portion;

a core having a tungsten carbide composition and rigidly secured to the body in the outlet of the passage, the core being cylindrical and having a diameter less than one-half the diameter of the sidewall portion of the bit, the core having a nozzle passage offset from the axis of the bit and in communication with the drilling fluid passage;

resilient seal means located between the core and the outlet of the passage in the body for preventing leakage of drilling fluid around the core;

retaining means for axially retaining the core in the outlet of the passage in the body;

locking pin means located between the core and the body for preventing rotation of the core with respect to the body and for orienting the core; and at least one cutting element secured in the face of the core adjacent the nozzle passage, the composition of the core reducing drilling fluid erosion of the core in the vicinity of the cutting element that is located on the core.

2. An earth boring bit, comprising in combination:

a steel body having a face on its lower end that includes a circular central portion and a frusto-conical portion surrounding and extending upwardly from the central portion to a cylindrical sidewall portion at the periphery of the bit;

a drilling fluid passage, smaller in diameter than the central portion, extending axially through the bit and terminating in an outlet at the central portion;

a core having a tungsten carbide composition rigidly secured to the body in the outlet of the passage, the core being cylindrical and having a diameter less than one-half the diameter of the sidewall portion of the bit, the core having a nozzle passage offset from the axis of the bit and in communication with the drilling fluid passage; and a plurality of cutting elements, each having a tungsten carbide cylindrical stud and a cutting edge secured to the stud containing a polycrystalline diamond face that faces into the direction of rotation, the cutting elements being secured within holes formed in the central portion and frusto-conical portion of the bit, and at least one of the cutting elements being secured within a hole formed in the core adjacent the nozzle passage, the composition of the core reducing drilling fluid erosion of the core in the vicinity of the cutting element that is located in the core.

3. An earth boring bit, comprising in combination:

a steel body having a face on its lower end that includes a circular central portion and a frusto-conical portion surrounding and extending upwardly from the central portion to a cylindrical sidewall portion at the periphery of the bit;

a drilling fluid passage, smaller in diameter than the central portion, extending axially through the bit and terminating in an outlet at the central portion;

a plurality of cutting elements secured within holes formed in the central portion and frusto-conical portion, each cutting element having a tungsten carbide cylindrical stud and a cutting edge secured to the stud with a polycrystalline diamond face;

a core having a tungsten carbide composition and secured to the body in the outlet of the passage, the core being cylindrical and having a diameter less than one-half the diameter of the sidewall portion of the bit, the core having a nozzle passage in communication with and offset from the axis of the drilling fluid passage;

resilient seal means located between the core and the outlet of the passage in the body for preventing leakage of drilling fluid around the core;

retaining means for axially retaining the core in the outlet of the passage in the body;

locking pin means located between the core and the body for preventing rotation of the core with respect to the body and for orienting the core; and at least one cutting edge carried by the core in the central area of the core, the cutting edge being a disk having a polycrystalline diamond face that faces into the direction of rotation of the bit, the cutting edge being located adjacent the nozzle passage, the composition of the core reducing drilling fluid erosion of the core in the vicinity of the cutting edge that is located on the core.

4. An earth boring bit, comprising the combination:

a steel body having a face on its lower end that includes a circular central portion and a frusto-conical portion surrounding and extending upwardly from the central portion to a cylindrical sidewall portion at the periphery of the bit;

a drilling fluid passage, smaller in diameter than the central portion, extending axially through the bit and terminating in an outlet at the central portion;

a plurality of cutting elements secured within holes formed in the central portion and frusto-conical portion, each cutting element having a tungsten carbide cylindrical stud and a cutting edge secured to the stud with a polycrystalline diamond face;

a core having a tungsten carbide composition and secured to the body in the outlet of the passage, the core being cylindrical and having a diameter less than one-half the diameter of the sidewall portion of the bit, the core having a nozzle passage in communication with and offset from the axis of the drilling fluid passage; and resilient seal means located between the core and the outlet of the passage in the body for preventing leakage of drilling fluid around the core;

retaining means for axially retaining the core in the outlet of the passage in the body;

locking pin means located between the core and the body for preventing rotation of the core with respect to the body and for orienting the core; and at least one cutting edge carried by the core, the cutting edge being a disk having a polycrystalline diamond face that faces into the direction of rotation of the bit, the cutting edge being located adjacent the nozzle passage, the composition of the core reducing drilling fluid erosion of the core in the vicinity of the cutting edge that is located in the core;

the nozzle passage having a diameter that is greater than one-half the width of the face of the cutting edge that is located in the core, the core having a diameter that is at least twice the width of the face of the cutting edge that is located in the core.

* * * * *